US007766582B2

(12) United States Patent
Worley

(10) Patent No.: US 7,766,582 B2
(45) Date of Patent: Aug. 3, 2010

(54) DEVICE AND METHOD FOR TRANSPORTING TRENCH BOXES

(75) Inventor: Joseph W. Worley, Genoa, OH (US)

(73) Assignee: J Walker Concepts LLC, Genoa, OH (US)

( * ) Notice: Subject to any disclaimer, the term of this patent is extended or adjusted under 35 U.S.C. 154(b) by 167 days.

(21) Appl. No.: 12/042,413

(22) Filed: Mar. 5, 2008

(65) Prior Publication Data

US 2008/0247831 A1 Oct. 9, 2008

Related U.S. Application Data

(60) Provisional application No. 60/910,075, filed on Apr. 4, 2007.

(51) Int. Cl.
*E21D 5/00* (2006.01)

(52) U.S. Cl. ..... 405/282; 405/272

(58) Field of Classification Search ..... 405/272, 405/273, 282, 283
See application file for complete search history.

(56) References Cited

U.S. PATENT DOCUMENTS 4,486,050 A * 12/1984 Snyder ..... 299/18
4,682,914 A * 7/1987 Aihara et al. ..... 405/283
4,714,381 A 12/1987 Hatch
4,741,646 A 5/1988 Hatch
5,209,606 A 5/1993 Plank
5,259,705 A 11/1993 Breaux et al.
5,287,879 A * 2/1994 Leggett et al. ..... 137/246.22
5,709,917 A 1/1998 Carmien
5,735,642 A 4/1998 Barringer
5,839,707 A 11/1998 Barringer
5,865,567 A 2/1999 Wilkinson
5,931,608 A 8/1999 Wilkinson
7,056,067 B2 6/2006 Kadiu
7,056,068 B2 6/2006 Kadiu

* cited by examiner

*Primary Examiner*—David J Bagnell
*Assistant Examiner*—Benjamin Fiorello
(74) *Attorney, Agent, or Firm*—Fraser Clemens Martin & Miller LLC; J. Douglas Miller

(57) ABSTRACT

A handling device for depositing a trench box into an open excavation includes at least one reciprocal trench box wall contact member movable along a first axis; motor means for selective movement of the wall contact member; and a coupling for attaching the contact member and the motor means to a prime mover for selectively moving the handling device along an axis generally perpendicular to the first axis. A system for depositing a trench box in an open excavation includes the handling device and a trench box having a plurality of apertures engageable with the at least one wall contact member. A method for depositing a trench box in an open excavation includes operating the handling device with the trench box having the apertures.

15 Claims, 5 Drawing Sheets

DEVICE AND METHOD FOR TRANSPORTING TRENCH BOXES

CROSS-REFERENCE TO RELATED APPLICATION

This application claims the benefit of U.S. Provisional Application No. 60/910,075, filed on Apr. 4, 2007. The disclosure of the above application is incorporated herein by reference.

FIELD OF THE INVENTION

The present invention relates to shoring devices for open excavations and, more particularly, to a handling device for depositing trench boxes into open excavations.

BACKGROUND OF THE INVENTION

Shoring devices are known in the art for securing open excavations. For example, shoring devices are used for trenches that are excavated prior to laying conduits and plumbing. The shoring devices are used for securing the walls of the excavations and the working space therein. One type of shoring device is commonly called a trench box or a trench shield. Trench boxes generally have two spaced apart panels or walls separated by individual spreaders pinned or bolted into the extremities of each panel, typically via flanges or fixed connectors. Trench boxes are generally rigid and militate against a relative movement between the spreaders and the panels. In open excavations that are deeper than the height of an individual trench box, multiple trench boxes are stacked to achieve a desired height and to shore the walls of the trench.

Typically, trench boxes are transported and deposited within excavated trenches with a prime mover, such as an excavator or like lifting machine. Trench boxes include eye-hooks adapted to couple with a hook attached to a boom or arm of the excavator, for example. The trench box is then lifted, transported, and positioned as desired with the excavator. These conventional systems necessitate that an individual enter the trench, however, following insertion of the trench box to uncouple the excavator and the trench box. Entering the trench when there is open excavation above the trench box is a perilous activity.

There is a continuing need for a device and method adapted to provide a rapid and safe transport and insertion of a trench box into an excavated trench. Desirably, the device and method facilitate a rapid stacking of multiple trench boxes in a deep excavated trench.

SUMMARY OF THE INVENTION

In concordance with the instant disclosure, a handling device and method adapted to provide a rapid and safe transport and insertion of a trench box into a trench, and facilitate a rapid stacking of multiple trench boxes in deep trenches, is surprisingly discovered.

In one embodiment, a handling device for depositing a trench box into an open excavation is described. The handling device includes at least one reciprocal trench box wall contact member movable along a first axis, and motor means for selective movement of the wall contact member. The handling device also has a coupling for attaching the contact member and the motor means to a prime mover. The coupling provides for a selective movement of the handling device along an axis generally perpendicular to the first axis.

In a further embodiment, a system for shoring walls of an open excavation is described. The system includes the handling device and a trench box having at least one aperture engageable with the at least one wall contact member of the handling device.

In another embodiment, a method for shoring walls of an open excavation is described. The method first includes the steps of: providing the handling device; and providing the trench box having the at least one aperture engageable with the at least one wall contact member of the handling device. The method further includes the steps of: attaching the handling device to the prime mover; engaging the at least one wall contact member with at least one aperture, thereby attaching the trench box to the handling device; depositing the trench box into an open excavation as desired; and disengaging the at least one wall contact member from at least one aperture, thereby detaching the trench box from the handling device and shoring walls of the open excavation.

DRAWINGS

The above, as well as other advantages of the present disclosure, will become readily apparent to those skilled in the art from the following detailed description, particularly when considered in the light of the drawings described hereafter.

DETAILED DESCRIPTION OF THE INVENTION

Figure 1:
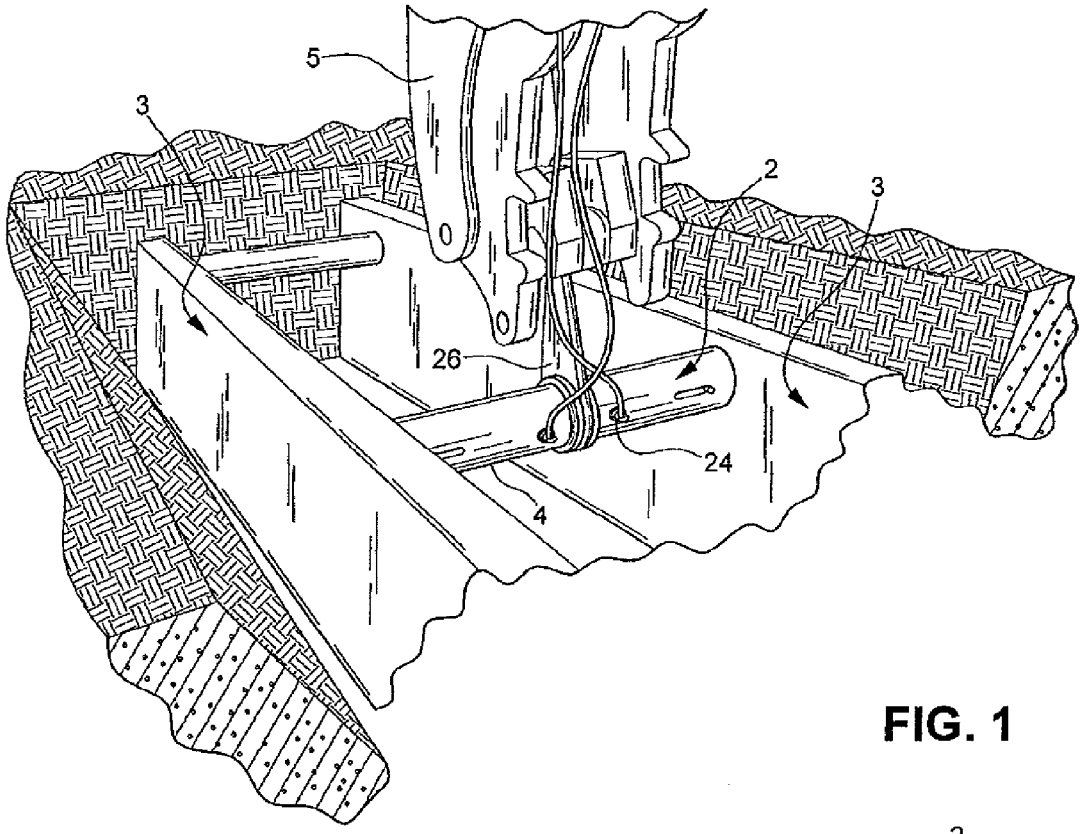
FIG. 1 is a fragmentary perspective view of a handling device according to one embodiment of the present disclosure, the handling device removably attached to a trench box.

The following description is merely exemplary in nature and is not intended to limit the present disclosure, application, or uses. It should also be understood that throughout the drawings, corresponding reference numerals indicate like or corresponding parts and features. In respect of the methods disclosed, the steps presented are exemplary in nature, and thus, are not necessary or critical.

As now shown FIGS. 1-4, the present invention includes a handling device 2 for depositing a trench box 3 into an open excavation, such as a trench. The handling device 2 is shown coupled to the trench box 3 and forming a system for shoring walls of the open excavation and militating against an excavation collapse. The handling device 2 may be adapted to engage the walls of the trench box 3. In a particular embodiment, the trench box 3 may have at least one aperture A engageable with the at least one wall contact member 8 of the handling device 2, as is clearly illustrated in FIGS. 2 and 3. The at least one wall contact member 8 may be a pin, for example. The at least one aperture A may be drilled or otherwise formed into the walls of the trench box 3, for example. In a particular embodiment, at least one aperture A is formed from metal pipes inserted into the walls of the trench box 3. As should be understood, each of the at least one aperture A is formed in the walls of the trench box 3 at suitable locations facilitating a balancing of the trench box 3 when the trench box 3 is lifted by the handling device 2 with a prime mover 5.

An exemplary handling device 2 of the present invention includes a housing 4 that is removably attachable to the prime mover 5. For example, the housing 4 may be removably attachable to an outer boom end or an arm of the prime mover 5 for selective movement along an axis generally perpendicular to a first axis. The handling device 2 further includes at least one motor means 6 disposed in the housing 4. At least one wall contact member 8 is coupled to the motor means 6 and configured to move along the first axis and engage the trench box 3. The housing 4 may be removably attachable to the prime mover 5 by means of a coupling 10 attached to the housing 4.

For simplicity, one of the at least one housing 4, motor means 6, and wall contact member 8 is described herein below with respect to the handling device 2 shown in FIGS. 2 to 4. It will be understood that the handling device 2 may include a plurality of the housings 4, a plurality of the motor means 6, and a plurality of the wall contact members 8 in any suitable configuration for selectively engaging the trench box 3, as desired.

Figure 2:
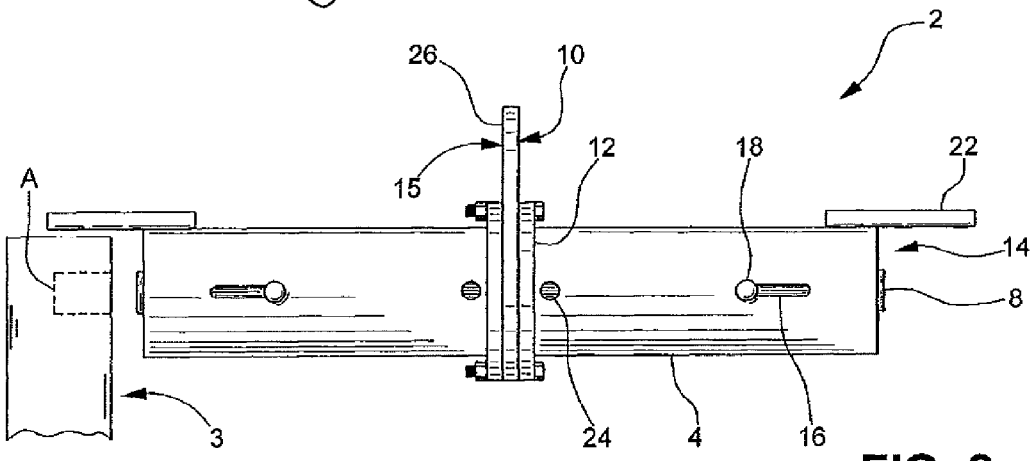
FIG. 2 is an elevational view of the handling device depicted in FIG. 1, showing engagement wall contact members in a disengaged position.
Figure 3:
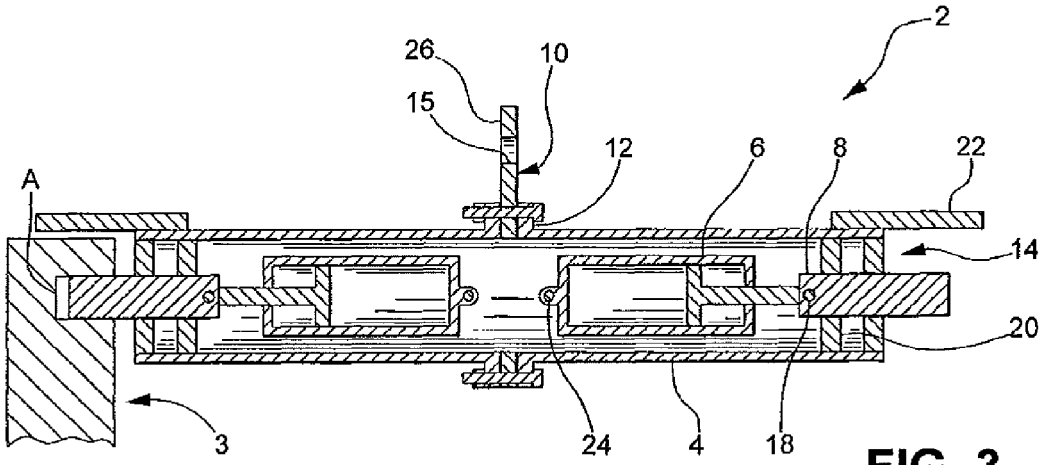
FIG. 3 is a cross-sectional view of the handling device depicted in FIG. 2, showing the wall contact members in an engaged position.
Figure 4:
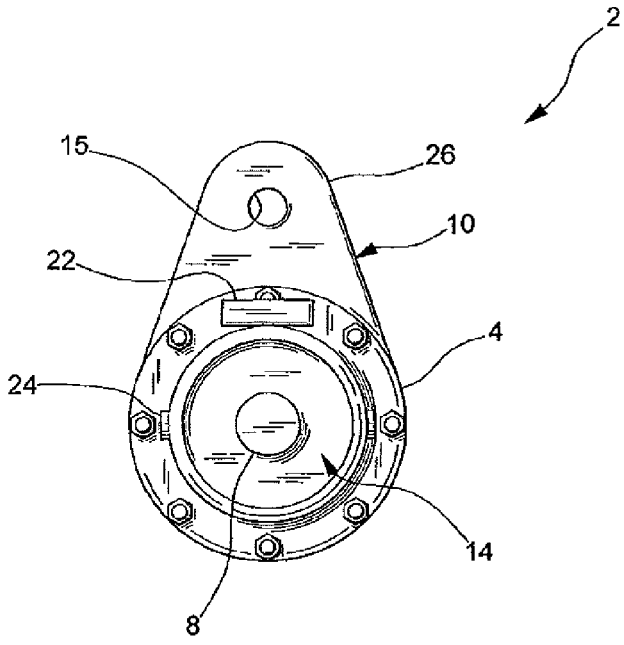
FIG. 4 is a handling device coupling according to one embodiment of the present invention, for use with one of a clevis and hook of a prime mover, the coupling attached to the handling device depicted in FIGS. 1 to 3.
Figure 5:
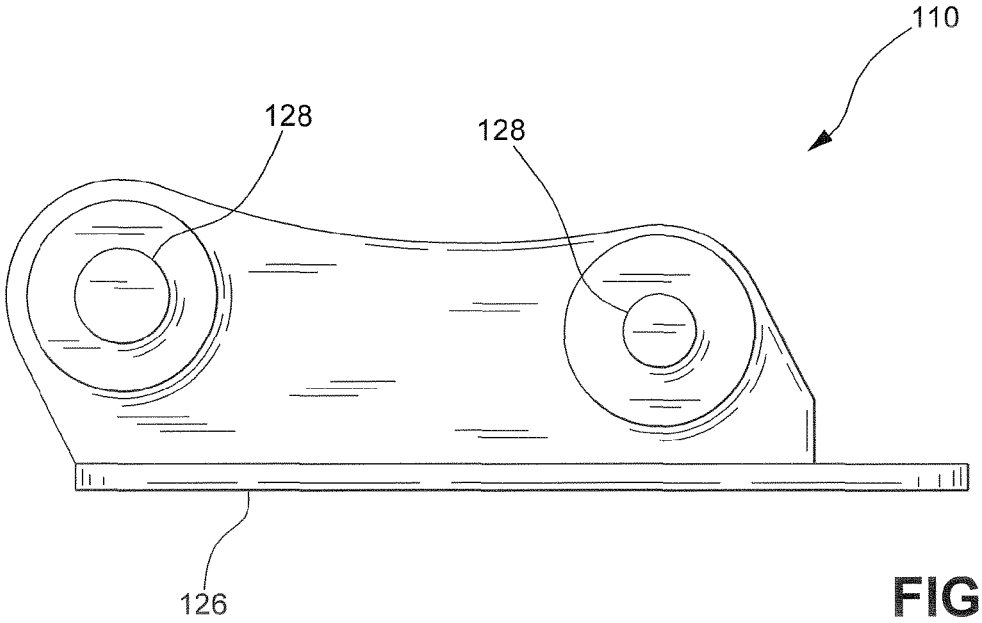
FIG. 5 is a side elevational view of a handling device coupling according to another embodiment of the present invention, for use with a hydraulic quick coupler of a prime mover.
Figure 6:
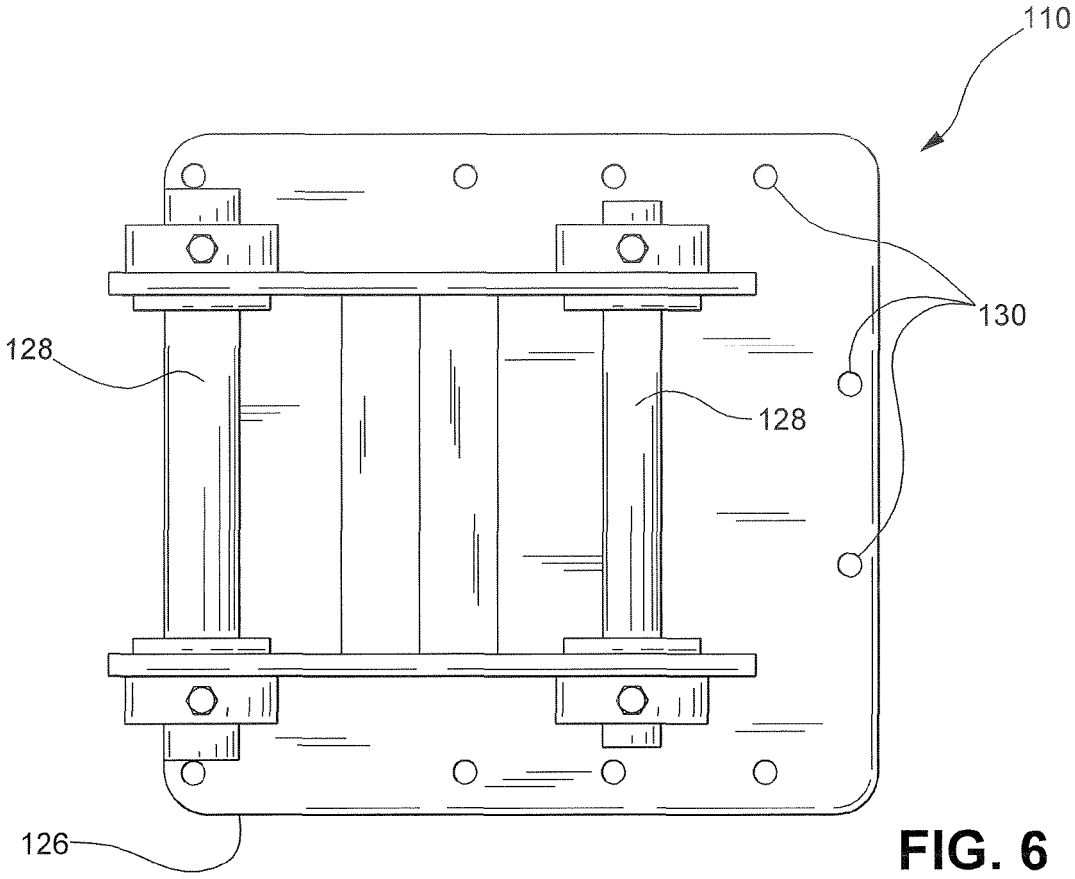
FIG. 6 is a top plan view of the coupling depicted in FIG. 5.

In reference to FIGS. 2 to 4, the housing 4 may include a hollow metal cylinder such as, for example, a metal pipe having a diameter sufficient to house the motor means 6. The housing 4 may have one or more flanged portions 12. The flanged portions 12 may be fastened together, for example, with bolts to form the housing 4. It should be understood that other means for fastening the flanged portions 12 may be used as desired. One or more spacers (not shown) may be inserted between the flanged portions 12. The spacers may also be bolted into place and adapted to expand a width of the handling device 2 as desired. It should be understood that the spacers allow the handling device 2 to be employed with trench boxes 3 having different widths. A width of the handling device 2 may also be adjusted by other suitable means, such as telescoping means, for example.

The motor means 6 of the handling device 2 may be any motor means capable of selectively extending and holding the wall contact member 8 in an engaged position and selectively retracting and holding the wall contact member 8 in a non-engaged position. For example, the motor means 6 may be capable of selectively outwardly extending the wall contact member 8. In one particular embodiment, the motor means 6 is a hydraulic motor. In other embodiments, the motor means 6 is one of a pneumatic motor, an electric motor, a linear motor, and the like. The motor means 6 is configured to cause a movement of the at least one wall contact member 8 into the engaged position or the non-engaged position with respect to the trench box 3, as desired. A skilled artisan should appreciate that other suitable motor means 6 may be used.

The at least one motor means 6 may be in fluid communication with a hydraulic circuit (not shown) of the prime mover 5. The handling device 2 includes at least one hydraulic hose adapted for fluid communication with the hydraulic circuit. The hydraulic hose may have quick couplings to facilitate a rapid set up of the handling device 2. Other suitable means of controlling an actuation of the at least one motor means 6 may also be employed.

In certain embodiments shown in FIGS. 2 to 4, the handling device 2 includes two motor means 6, each of the motor means 6 coupled to different wall contact members 8. The wall contact members 8 are configured to move outwardly upon actuation of the motor means 6 in substantially opposite directions. Thus, it should be understood that the handling device 2 may be freely inserted into the trench box 3 and subsequently coupled to the trench box 3 upon the actuation of the wall contact members 8 by the motor means 6. Such actuation causes a width of the handling device 2 to increase and the wall contact members 8 to engage the walls of the trench box 3. It should be further understood that the wall contact members 8 may be configured to engage same or different positions on the opposite walls of the trench box 3 as desired.

The at least one wall contact member 8 of the handling device 2 may have any shape suitable for engaging the trench box 3. For example, the at least one wall contact member 8 may be substantially cylindrical. To particular embodiments, the at least one wall contact member 8 is adapted to engage at least one aperture A formed in a wall of the trench box 3. The at least one wall contact member 8 may be formed from any material having strength suitable for supporting the weight of the trench box 3 when the handling device 2 is lifted by the prime mover 5.

The wall contact member 8 is typically formed from metal, such as a steel bar. The wall contact member 8 may also have a varying width from one end of the wall contact member 8 to another end of the wall contact member 8. For example, the wall contact member 8 may be wider at an end that adapted to engage the trench box 3 than at an end coupled to the motor means 6. An engaging end of the wall contact member 8 may provide a greater surface area to contact the inner wall of the trench box 3. The engaging end of the wall contact member may also be at least one of shaped and textured to optimize an engagement of the wall contact member 8 with the trench box 3. For example, the engaging end of the wall contact member 8 may have a gripping surface that includes a roughened surface texture adapted to provide a friction-based coupling of the handling device 2 with the trench box 3. Other suitable materials, configurations, and textures of the wall contact member 8 may also be employed.

The housing 4 may include at least one opening 14 formed therein for the at least one wall contact member 8 to selectively move outwardly therethrough. The housing 4 may further include a slot 16 formed therein and adapted to receive a locking indicator 18. The locking indicator 18 may be a bolt or other projection, for example, that is connected to the at least one wall contact member 8. As the wall contact member 8 is moved by an actuation of the motor means 6, the locking indicator 18 slides in the slot 16 and thereby indicates the movement of the wall contact member 8. In particular, the locking indicator 18 indicates whether the wall contact members 8 are engaging the trench box 3. Other suitable means for indicating the position of the wall contact members 8 may be used as desired.

In some embodiments, the housing 4 may have one or more wall contact member guides 20 disposed inside the housing 4 for receiving the wall contact members 8 and facilitating transitory movement of the wall contact members 8. The wall contact member guide 20 is adapted to guide the wall contact member 8 through the opening 14 in the housing 4 when the wall contact member 8 is actuated to engage the trench box 3. The wall contact member guide 20 may include a ring through which the wall contact member 8 is disposed.

The housing may further include one or more stabilizers 22 adapted to contact a top surface of the trench box 3 when the handling device 2 has been lowered to a point suitable for engagement. The stabilizer 22 may be disposed on and overhang the housing 4, for example. The stabilizer 22 may militate against an undesirable movement of the trench box 3 during a transport thereof with the handling device 2. The stabilizer 22 may also be adjustable to allow a selective positioning of the handling device 2 in the trench box 3 to a desired depth.

As a further example, the housing 4 may include suitable hydraulic fittings 24 to enable a fluid communication between the hydraulic circuit of the prime mover 5 and the hydraulic motors employed as motor means 6. The hydraulic fittings 24 may alternatively be placed in fluid communication with a hydraulic circuit independent from the prime mover 5. The independent hydraulic circuit may be dedicated to the control of the handling device 2, for example.

In one embodiment shown in FIG. 4, the coupling 10 is formed from a plate 26 attached to the housing 4. The coupling 10 may be attached to the housing, for example, with one or more bolts disposed through suitably aligned bolt holes formed in the plate 26 and the flanged portions 12. Other suitable means for fastening the coupling 10 to the housing 4, such as welding and the like, may also be employed. The coupling 10 can be formed from any conventional material having sufficient strength to support the weight of the trench box 3 with the prime mover 5, such as steel, for example.

The coupling 10 may be removably attached to the excavator arm of the prime mover 5, using a clevis or a hook, for example. The plate 26 may have an aperture 15 formed therein. In particular embodiments, the aperture 15 is adapted to cooperate with and receive one of the clevis, the hook, and another suitable connector of the prime mover 5. The coupling 10, in one example, is connected to the handling device 2 at a substantially central location, thereby facilitating a balancing of the handling device 2 when lifted at the coupling 10. The coupling 10 may further be rotatable about a central axis of the coupling 10. It should be appreciated that other suitable means for removably attaching the coupling 10 to the prime mover 5 may be employed as desired.

With reference to FIGS. 5 to 8, further embodiments according to the present invention are shown. Like or repeated structure are indicated with the same reference numeral and a prime (') for purpose of clarity.

A coupling 110 according to another embodiment of the disclosure may include the plate 126 having a pair of spaced apart attachment shafts 128. The spaced apart attachment shafts 128 are adapted to latch with a hydraulic quick coupler (not shown) of a prime mover as is known in the art. A bucket (not shown) on the prime mover may be removed prior to attaching the handling device 102 to the prime mover so that the hydraulic circuit of the prime mover may be used for an operation of the handling device 102. For example, the motor means 106 may be connected to the hydraulic circuit of the prime mover via the hydraulic quick coupler on the prime mover. The plate 126 of the coupling 110 may be connected to the handling device 102 with one or more suitable fasteners, for example, bolts disposed through bolt holes 130 formed in the plate 126. Other suitable means for fastening the coupling 110 to the handling device 102 may be employed as desired.

FIGS. 7 to 10 show the handling device 102 according to another embodiment of the present invention. The handling device 102 is shown fully assembled with the coupling 110 described hereinabove. The handling device 102 includes the housing 104 having the motor means 106 and the motor means 106' disposed therein. The motor means 106 is coupled to the wall contact member 108 and the motor means 106' is coupled to the wall contact member 108'. The motor means 106 is configured to move the wall contact member 108 in a direction substantially opposite a movement of the wall contact member 108' by the second motor means 106'. The wall contact member 108 selectively outwardly extends through the opening 114 formed in the housing 104 and the wall contact member 108' selectively outwardly extends through the opening 114' formed in the housing 104, as desired. The wall contact members 108, 108' are configured to engage different walls of the reciprocal trench box 3. For example, the wall contact member 108 is configured to engage a first wall of the trench box 3 and the wall contact member 108' is configured to engage a second wall of the trench box 3. A width of the handling device 102 may also be adjustable by other means, such as telescoping means, for example.

Figure 7:
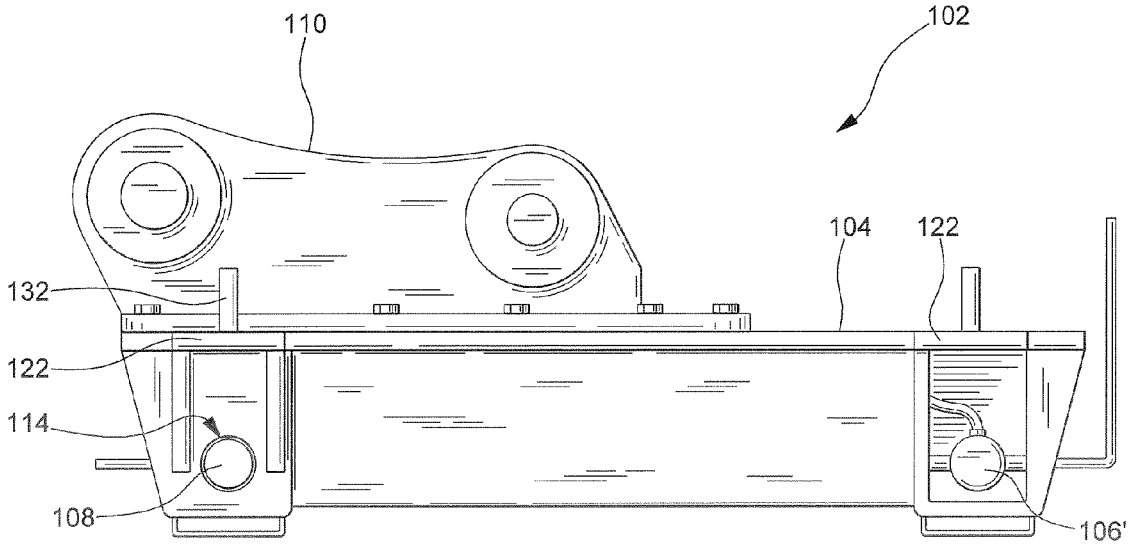
FIG. 7 is a side elevational view of a handling device according to another embodiment of the present invention, attached to the coupling depicted in FIGS. 5 and 6 and showing the wall contact members in a retracted disengaging position.
Figure 8:
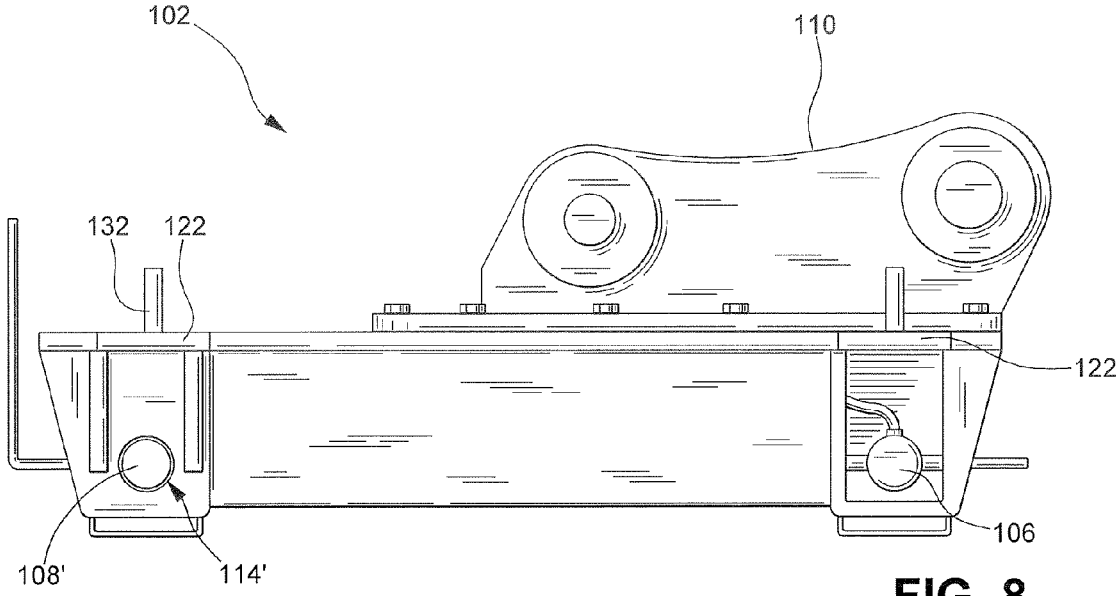
FIG. 8 is an elevational view of the opposite side of the handling device shown in FIG. 7, the handling device attached to the coupling depicted in FIGS. 5 and 6.
Figure 9:
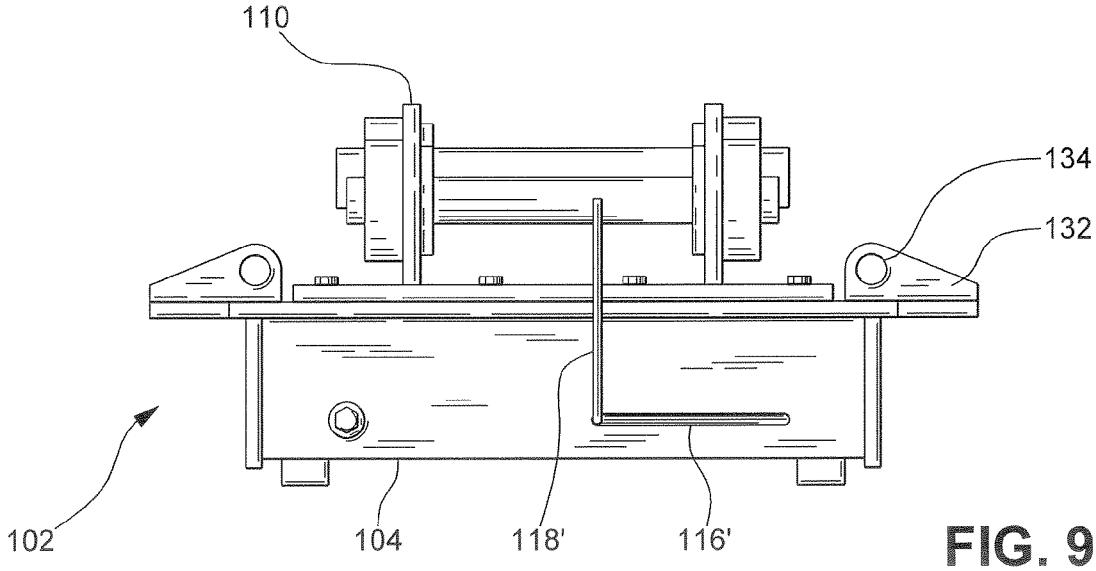
FIG. 9 is a front elevational view of the handling device shown in FIGS. 7 and 8, further showing a locking indicator.
Figure 10:
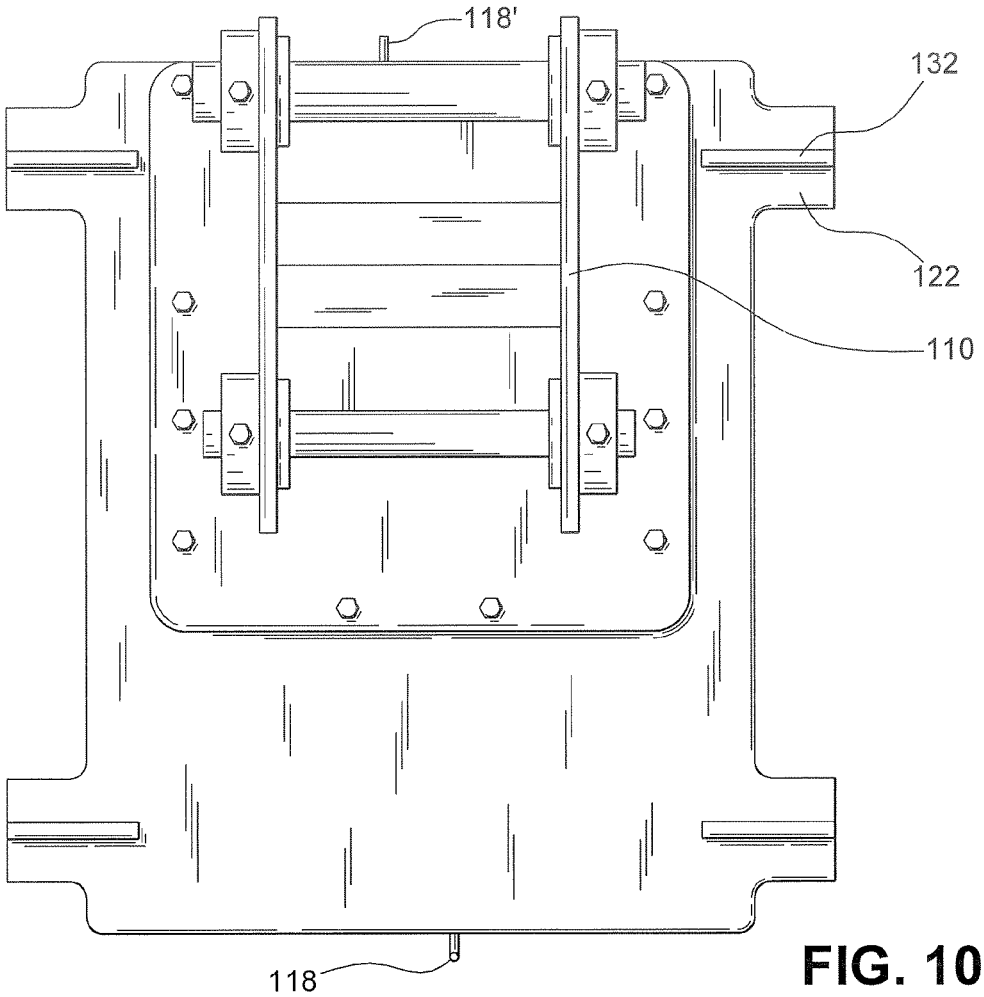
FIG. 10 is a top plan view of the handling device depicted in FIG. 7 to 9.

The wall contact member 108 may be configured to selectively engage a first wall of the trench box 3 at a first position. The wall contact member 108' may be configured to selectively engage a second wall of the trench box 3 at an opposed second position. The first and second positions may be substantially the same, for example, as would result from a configuration of the motor means 106, 106' as show in FIGS. 1 to 3. The first and second positions may further be vertically offset and horizontally offset. As shown in FIGS. 7 and 8, the motor means 106, 106' are horizontally offset from one another so as to facilitate an engagement of the wall contact members 108, 108' at different and horizontally offset first and second positions on opposite walls of the trench box 3. It should be appreciated that the horizontal offset of the first and second motor means 106, 106' may militate against a pivoting of the handling device 102 during the transport and positioning of the trench box 3. The horizontal offset of the motor means 106, 106' may also facilitate the controllability of the handling device 102.

The handling device 102 further includes the stabilizers 122 for contacting the top surface of the trench box 3 and facilitating the controllability of the trench box 3 during the transporting operation of the trench box 3. The stabilizers 122 may be coupled to at least one brace 132. The brace 132 may provide supplementary control of the trench box 3 during the transporting of the trench box 3. For example, the brace 132 may have at least one brace aperture 134 suitable for attachment to cables, rope, and the like for guiding the handling device 102 into a desired position. The brace 132 may facilitate a movement and positioning of the handling device 102 absent a coupling of the handling device 102 with the prime mover.

In further embodiments, the handling device 102 includes the slot 116 and the slot 116' formed in the housing 104. The locking indicator 118 coupled to the first wall contact member 108 extends outwardly through the first slot 116. The locking indicator 118' coupled to the wall contact member 108' extends outwardly through the second slot 116'. A length of the locking indicator 116' may be greater than a length of the locking indicator 118, for example, to facilitate a viewing of the locking indicator 118' by an operator of the prime mover.

At least one of the locking indicators 118, 118' may be angled to facilitate the viewing thereof by the operator. As a nonlimiting example, at least one of the locking indicator 18' and the locking indicator 118' may be substantially L-shaped. Other suitable shapes and means for optimizing a visibility of the locking indicators 118, 118' may also be employed.

As should be understood, the handling device of the present disclosure may be employed to shore walls of an open excavation such as a trench, and to militate against a collapse thereof. The method first includes providing the handling device having the housing removably attachable to the prime mover; the at least one motor means disposed in the housing; and the at least one wall contact member coupled to the motor means and configured to selectively engage the trench box. The handling device is then attached to the prime mover. For example, the method may also comprise the steps of providing a coupling configured to be coupled with the prime mover, attaching the coupling to the housing providing the prime mover having one of a clevis, a hook, and a hydraulic quick coupler, and coupling the coupling to the prime mover with one of the clevis, the hook, and the hydraulic quick coupler.

The present method further includes the step of transporting the handling device in a disengaged position to the trench box. The coupling is attached to the prime mover, such as with one of the clevis, hook, and hydraulic quick coupler as described herein. The step of attaching the coupling to the prime mover may include disconnecting another work implement from the prime mover and placing the at least one motor means of the handling device in fluid communication with the hydraulic circuit of the prime mover. The selective engagement of the handling device with the trench box may thereby be directly controlled by the operator of the prime mover.

The handling device is positioned in the trench box in the disengaged position. For example, the handling device may be positioned so that the stabilizer is placed adjacent the top surfaces of the trench box walls and so that the at least one wall contact member is substantially aligned with the at least one aperture formed in the trench box. The at least one wall contact member is then engaged with the at least one aperture formed in the trench box, for example, by an actuation of at least one of the motor means to cause the at least one wall contact member to move outwardly and be inserted into the at least one aperture. The trench box is thereby engaged by and securely attached to the handling device.

After the trench box is engaged by the handling device, the operator may then lift the trench box and transport the trench box as desired. For example, the operator may deposit the trench box into an open excavation. Once the trench box is deposited, the operator may then disengage the at least one wall contact member from the at least one aperture formed in the trench box. The at least one wall contact member retracts toward the handling device when disengaged. The trench box is thereby detached from the handling device and the walls of the open excavation are shored against a collapse.

One of ordinary skill in the art should appreciate that the method of the present disclosure may be repeated as necessary to stack multiple trench boxes atop one another, particularly when the depth of the open excavation is greater than the height of the individual trench box.

It should further be understood from the description provided herein that the handling device and method provide for a rapid and safe insertion of the trench box into the open excavation or trench. An individual is not required to enter the open excavation and manually release the trench box when employing the present handling device and the associated method. The device and method of the present disclosure further facilitate a rapid stacking of multiple trench boxes in deep excavations. Time is also saved by removing the need for the manual release of the trench box from the prime mover.

While certain representative embodiments and details have been shown for purposes of illustrating the invention, it will be apparent to those skilled in the art that various changes may be made without departing from the scope of the disclosure, which is further described in the following appended claims.

What is claimed is:

1. A trench box handling device, comprising:

a first axis a first wall contact member movable along a first axis;

a second wall contact member movable along one of the first axis and a second axis;

a housing having a first opening and a second opening formed therein, the first wall contact member and the second wall contact member disposed at least partly in the housing, the first opening configured for the first wall contact member to selectively move outwardly therethrough, and the second opening configured for the second wall contact member to selectively move outwardly therethrough;

a first motor means configured to actuate the first wall contact member, and a second motor means configured to actuate the second wall contact member, the first wall contact member coupled to the first motor means and the second wall contact member coupled to the second motor means; and a coupling for attaching the first and second wall contact members and the first and second motor means to a prime mover, the coupling including a pair of spaced apart attachment shafts attached to the housing and configured to cooperate with a hydraulic quick coupler of the prime mover, wherein the first wall contact member is configured to selectively engage an aperture formed in an inner surface of a first wall of the trench box at a first position, and the second wall contact member is configured to selectively engage an aperture formed in an inner surface of a second wall of the trench box at a second position.

2. The handling device according to claim 1, further including a housing having the motor means and the contact member disposed therein.

3. The handling device according to claim 1, wherein the motor means is one of a hydraulic motor, a pneumatic motor, an electric motor, and a linear motor.

4. The handling device according to claim 1, wherein the first position is at least one of vertically offset and horizontally offset from the second position.

5. The handling device according to claim 1, further comprising at least one locking indicator coupled to one of the first wall contact member and the second wall contact member, the locking indicator extending through the housing and visually indicating a movement of one of the first wall contact member and the second wall contact member.

6. The handling device according to claim 1, further including at least one stabilizer attached thereto and adapted to sit atop the trench box, the stabilizer militating against an undesirable movement of the trench box when engaged by the handling device.

7. The handling device according to claim 6, wherein the stabilizer includes a brace for supplementary control of the handling device relative the trench box.

8. The handling device according to claim 1, further including at least one guide member adapted to direct one of the first wall contact member and the second wall contact member to selectively engage the trench box.

9. A system for shoring walls of an open excavation, the system comprising:

a handling device removably attachable to a prime mover, the handling device including at least one reciprocal trench box wall contact member movable along a first axis, motor means for selective movement of the wall contact member, and a coupling for attaching the contact member and the motor means to a prime mover; and a trench box having a first wall and a second wall, at least one aperture formed in an inner surface of each of the first wall and the second wall, the at least one aperture engageable with the at least one wall contact member, wherein the handling device enables transportation of the trench box by the prime mover when the at least one wall contact member is engaged with the at least one aperture of the trench box.

10. The system according to claim 9, wherein the at least one wall contact member includes a first wall contact member and a second wall contact member, first wall have a first aperture engageable with the first wall contact member and the second wall having a second aperture engageable with the second wall contact member.

11. The system according to claim 9, wherein the at least one reciprocal trench box wall contact member includes a first wall contact member movable along the first axis, and a second wall contact member movable along one of the first axis and a second axis, wherein the motor means includes first motor means configured to actuate the first wall contact member, and a second motor means configured to actuate the second wall contact member, the first wall contact member coupled to the first motor means and the second wall contact member coupled to the second motor means, wherein the handling device further includes a housing having a first opening and a second opening formed therein, the first wall contact member and the second wall contact member disposed at least partly in the housing, the first opening configured for the first wall contact member to selectively move outwardly therethrough, and the second opening configured for the second wall contact member to selectively move outwardly therethrough, wherein the coupling for attaching the at least one wall contact member and the motor means to the prime mover includes a pair of spaced apart attachment shafts attached to the housing and configured to cooperate with a hydraulic quick coupler of the prime mover, and wherein the first wall contact member is configured to selectively engage the aperture formed in the inner surface of the first wall of the trench box at a first position, and the second wall contact member is configured to selectively engage the aperture formed in the inner surface of the second wall of the trench box at a second position.

12. A method for shoring walls of an open excavation, the method comprising the steps of:

providing a handling device removably attachable to a prime mover, the handling device including at least one reciprocal trench box wall contact member movable along a first axis, motor means for selective movement of the wall contact member, and a coupling for attaching the contact member and the motor means to a prime mover;

providing a trench box having a first wall and a second wall, at least one aperture formed in an inner surface of each of the first wall and the second wall, the at least one aperture engageable with the at least one wall contact member;

attaching the handling device to the prime mover;

engaging the at least one wall contact member with the at least one aperture, thereby attaching the trench box to the handling device;

depositing the trench box into an open excavation; and disengaging the at least one wall contact member from the at least one aperture, thereby detaching the trench box from the handling device and shoring the open excavation.

13. The method according to claim 12, further comprising the steps of:

providing a coupling;

attaching the coupling to the housing;

providing the prime mover having one of a clevis, a hook, and a hydraulic quick coupler; and coupling the coupling to the prime mover with one of the clevis, the hook, and the hydraulic quick coupler.

14. The method according to claim 13, further comprising the step of:

placing the motor means in fluid communication with a hydraulic circuit of the prime mover, wherein the selective engagement of the handling device with the trench box may be directly controlled by an operator of the prime mover.

15. The method according to claim 12, wherein the at least one reciprocal trench box wall contact member includes a first wall contact member movable along the first axis, and a second wall contact member movable along one of the first axis and a second axis, wherein the motor means includes first motor means configured to actuate the first wall contact member, and a second motor means configured to actuate the second wall contact member, the first wall contact member coupled to the first motor means and the second wall contact member coupled to the second motor means, wherein the handling device further includes a housing having a first opening and a second opening formed therein, the first wall contact member and the second wall contact member disposed at least partly in the housing, the first opening configured for the first wall contact member to selectively move outwardly therethrough, and the second opening configured for the second wall contact member to selectively move outwardly therethrough, wherein the coupling for attaching the at least one wall contact member and the motor means to the prime mover includes a pair of spaced apart attachment shafts attached to the housing and configured to cooperate with a hydraulic quick coupler of the prime mover, and wherein the first wall contact member is configured to selectively engage the aperture formed in the inner surface of the first wall of the trench box at a first position, and the second wall contact member is configured to selectively engage the aperture formed in the inner surface of the second wall of the trench box at a second position.

* * * * *